US005922926A

United States Patent [19]

Back et al.

[11] Patent Number: 5,922,926

[45] Date of Patent: Jul. 13, 1999

[54] METHOD AND SYSTEM FOR THE DESTRUCTION OF HETERO-ATOM ORGANICS USING TRANSITION-ALKALINE-RARE EARTH METAL ALLOYS

[75] Inventors: Dwight Douglas Back, Melbourne; Charlie Ramos, Satellite Beach; John A. Meyer, Palm Bay, all of Fla.

[73] Assignee: Mainstream Engineering Corporation, Rockledge, Fla.

[21] Appl. No.: 08/863,335

[22] Filed: May 27, 1997

[51] Int. Cl.[6] ..... A62D 3/00

[52] U.S. Cl. ..... 588/205; 588/206; 588/207; 588/200; 75/255; 502/302; 502/306; 502/314

[58] Field of Search ..... 588/205, 206, 588/207, 200; 75/255; 252/181.4, 181.6, 181.7; 502/302, 306, 314

[56] References Cited

U.S. PATENT DOCUMENTS

| | | | |
|---|---|---|---|
| 4,300,946 | 11/1981 | Simons . | |
| 4,402,933 | 9/1983 | de Dous . | |
| 4,601,817 | 7/1986 | Globus . | |
| 4,668,424 | 5/1987 | Sandrock . | |
| 4,683,218 | 7/1987 | Slaugh . | |
| 4,893,756 | 1/1990 | Fetcenko et al. | 241/33 |
| 5,648,591 | 7/1997 | Donecker et al. | 588/205 |
| 5,673,556 | 10/1997 | Goldben et al. . | |

OTHER PUBLICATIONS

Capella, E.T., and Filho, J.M., Hydriding of Zirconium Sponge for Powder Production, *Congr. Anu.–Assoc. Bras. Metal. Mater.*, 48th(vol. 2), p. 117 (1993).

Carberry, J.J., "Chemical and Catalytic Reaction Engineering," McGraw–Hill Book Co., 1976, chapter 8.

Devgun, J., "Developing Innovative Environmental Technologies for DoE Needs," paper EI–330, proceeding of the 30th IECEC, Lake Buena Vista, FL, vol. 2, p. 49, Jul. 30–Aug. 4, 1995.

El–Shall, M.S., Slack, W., Hanley, D., and Kane, D., Characterization of Nanoscale Particles Produced by Laser Vaporization/Condensation in a Diffusion Cloud Chamber, *Mat. Res. Soc. Symp.*, 351, p. 369, 1994.

Gruber, W., "Ultrafine Metal Oxides Dismantle Chlorinated Organics," *Environ. Eng. World*, p. 36, Jul.–Aug. 1995.

Hess, K., Morsbach, B., Drews, R., Buechele, W., Schachner, H., "Metal oxide catalyst for oxidative decomposition of organics in flue gas," German patent 4116364 (1993). Abstract.

Manchester, F.D., and Khatamian, D., "Mechanisms for Activation of Intermetallic Hydrogen Absorbers," *Hydrogen Storage Materials in Materials Science Forum* (Trans Tech Publications, Switzerland), vol. 31, p. 261, 1988.

Nakamura, R., et al., "Effect of the Addition of Various Alkaline Metal Hydroxides to the Molybdenum (VI) Oxide–Aluminum Oxide catalyst on the Dispropotionation of Olefins," *Nippon Kagaku Kaishi*, 7, pp. 1138–1142, 1975. Abstract.

Okuda, H., Sintering of Titanium Hydride Powder Prepared with Ball Mill, *Kenkyu Hokoku*, 58, p. 131, 1987. Abstract.

Sasaki, Y., and Amano, M., Preparation and Comminution of Hydrogenated Niobium, *Nippon Kinzoku Gakkaishi*, 35(1), p. 77, 1971. Abstract.

Uenishi, N., and Takeda, Y., "Manufacture of sintered titanium alloy parts at low cost," Japanese patent 63089636 (1988). Abstract.

Utamapanya, S., Klabunde, K.J., and Schlup, J.R., Nanoscale Metal Oxide Particles/Clusters as Chemical Reagents. Synthesis and Properties of Ultrahigh Surface Area Magnesium Hydroxide and Magnesium Oxide, *Chem. Mater.*, 3(1), p. 175, 1991.

Wilcoxon, J., and Martino, A., "Tiny chunks of catalysts," in *Sandia Technology: Engineering and Science Accomplishments*, Sandia National Laboratories, p. 38, Feb. 1995.

Li, Y–X., and Klabunde, K.J., "Nanoscale Metal Oxide Particles as Chemical Reagents. Destructive Adsorption of a Chemical Agent Simulant, Dimethyl Methylphosphonate on Heat–Treated Magnesium Oxide," *Langmuir*, 7(7), pp. 1388–1393, 1991.

Li, Y–X., Koper, O., Atteya, M., and Klabunde, K.J., "Adsorption and Decomposition of Organophosphorous Compounds on nanoscale Metal Oxide Particles. In Situ GC–MS Studies of Pulsed Microreactions over Magnesium Oxide," *Chem. Mater.*, 4(2), pp. 323–330, 1992.

Itoh, H., Utamapanya, S., Stark, J.V., Klabunde, K.J., and Schlup, J.R., "Nanoscale Metal Oxide Particles as Chemical Reagents. Intrinsic Effects of Particles Size on Hydroxyl Content and on Reactivity and Acid/Base Properties of Ultrafine Magnesium Oxide", *Chem. Mater.*, 5(1), p. 71, 1993.

Klabunde, K.J., Activated Metal Oxide Surfaces as Highly Reactive Environments, Final Report contract DAAL03–87–K–0130, U.S. Army Research Office, RTP, NC, 1990. (DTIC Article AD–A227–990).

Koper, O., Yong, X.L., and Klabunde, K.J., Destructive Adsorption of Chlorinated Hydrocarbons on Ultrafine (Nanoscale) Particles of Calcium Oxide, *Chem. Mater.*, 5(4), p. 500, 1993.

*Primary Examiner*—Ngoclan Mai
*Attorney, Agent, or Firm*—Evenson, McKeown Edwards & Lenahan P.L.L.C.

[57] ABSTRACT

A method and system decomposes or immobilizes organic wastes using a metal alloy agent comprised of at least two metals selected from transition metals, alkaline metal and/or and rare earth metals. The method first uses hydrogen and oxygen, with and without mechanical agitation, to decrepitate and activate the metal alloy powders. The organic waste compounds are then introduced to the activated metal alloys. This method of decomposing organic materials effectively destroys organic compounds which contain halogens, sulfur, phosphorous, oxygen, and higher order bonds.

32 Claims, 2 Drawing Sheets

METHOD AND SYSTEM FOR THE DESTRUCTION OF HETERO-ATOM ORGANICS USING TRANSITION-ALKALINE-RARE EARTH METAL ALLOYS

The U.S. Government may have certain license rights to the invention described and claimed herein pursuant to contract DAAH04-95-C-0023 awarded by the Department of the Army.

BACKGROUND AND SUMMARY OF THE INVENTION

The present invention relates to the destruction of hetero-atom organics using transition-alkaline-rare earth metal alloys and, more particularly, to a method and system for decomposing or immobilizing organic wastes using metal alloys which have been decrepitated and activated by exposure to oxygen and hydrogen.

Oxides of alkaline metals are known to be effective in the destruction of a wide spectrum of waste chemicals including halogenated, sulfur-containing, and phosphorous-containing compounds. Compounds which contain double or triple bonds are also generally more reactive, and can also be decomposed or immobilized (e.g. adsorbed) by oxide materials. In particular, microscale and nanoscale metal oxides have been demonstrated to destroy compounds with byproducts of formic acid, $CO_2$, water, CO, and metal salts.

Several distinct preparation methods and final physical forms for these organic waste destruction materials are known in the art, including aerogels, high vacuum thermal activation, and laser vaporization/condensation. These oxides, which use an adsorption mechanism to decomposition organic compounds, can develop an "ash layer", presumed to be comprised of reaction products, through which the reacting species must diffuse prior to reaction with the underlying fresh substrate. Consequently, these metal oxides have the disadvantage of tending to develop a non-reacting barrier which slows or stops the organic compound decomposition process.

Metal hydrides are also used in organic chemical synthesis as a source of hydrogen. There are also commercial processes which use a separate catalyst and hydrogen gas as one reactant (e.g., polymerization, catalytic reformers).

Catalysts are known in the art to facilitate chemical reformation. By definition, a catalyst is a compound that does not directly participate in the reaction scheme of chemical process, but rather, the catalyst decreases the activation energy for the chemical process so that it may proceed at a more rapid pace or to higher conversion efficiencies. Generally, catalysts are broken down into three categories. The first category is metal conductors consisting of transition and precious metals such as Fe, Pt, Pd, and Ag can chemisorb oxygen and hydrogen and are generally used in hydrogenation and dehydrogenation reactions. The second category is insulators consisting of metal oxides such as $Al_2O_3$ and MgO, which are generally considered to be acidic, and are generally used in cracking, polymerization, alkylation, isomerization, and hydration-dehydration reactions. The third category is semiconductors, consisting of compounds such as NiO, ZnO, $TiO_2$, and $V_2O_5$. The catalytic capabilities of the semiconductor catalysts are well-known. Replacements for precious metal catalysts are also being developed, some comprised of nanoscale powders including iron, iron sulfide, and molybdenum disulfide.

Useful catalysts are also comprised of physical mixtures or combinations of the above-mentioned catalyst categories.

For example, a physical mixture of MgO and Ni is used for steam-methane reactions, Ag and $Al_2O_3$ is used as an ethylene oxide catalyst, $Zn_5Cu$ alloy catalysts is used for methanol synthesis, and Cu—Ni alloys are used for ethane hydrogenolysis. The use of catalytic metal oxides $MoO_3$—$Al_2O_3$ in physical combination with an alkali (Group IA) or alkaline (Group IIA) metal hydroxide is already known. Catalysts of many other transition metal combinations or transition metal-transition metal oxides have also been described in literature including Pd—Pt, Ru—Fe, Cu—ZnO, Fe—Cu, Cu—Co, Bi—Pt, Pd—Cu, Zn—Ru, Rh—Mo, Ni—Ru, and $ZrO_2$—CuO. The oxidation of chlorinated organics using physical mixtures of transition metal oxides, alkaline metal sulfates, and precious metals is also known.

The physical combination of $Fe_2O_3$ catalysts with CaO has also been suggested for the application of destructive adsorbents whereby the CaO is coated with a layer of $Fe_2O_3$. Coating or depositing a layer of catalytic transition metal oxide onto the surface of alkaline metal oxide has been met, however, with difficulty.

An object of the present invention is to provide an improved method for destroying hetero-atom organic compounds containing halogens and/or sulfur and/or phosphorous, and/or single, double or triple bonds by using a complex metal alloy comprised of one or more transition metals with one or more alkaline metal and/or one or more rare earth metal. We have found that a combination of these metals in the form of a metal alloy solid solution can improve the destructive potential over those produced by the metal components separately.

Another object of the present invention is to utilize the constituents of multi-component catalysts or destructive substrates in a combined chemical solid solution form, i.e. an alloy, rather than physical mixtures or coatings. The present invention is particularly advantageous in this regard because metallic alloy solutions place the components within atomic distances throughout the entire metal material, whereas coatings have specific two-dimensional contact points and physical mixtures have the metals separated by distances similar to the particle size.

The present invention has the substantial advantage over known methods in which physical combinations of the elements require complicated formulations, difficult deposition processes, considerable process control to insure homogenous mixing, and precautions to avoid mutual chemical reactions such as poisoning or consumption of one component by another.

The present invention recognizes that catalysts and destructive adsorbent metals and metal oxides, combined in an alloy form and activated in a system according to the present invention, will decompose organic molecules comprising hetero-atoms more efficiently than the constituents acting separately. This approach differs from conventional methods in that the synergy of using the constituents in chemical solutions or in an alloy has not been used for catalysis or destructive adsorption substrates.

The present invention also recognizes that metal catalysts and metal hydrides, combined in an alloy form and activated in the system according to the present invention, will react with hetero-atom containing organic species without the need for externally supplying the hydrogen gas and providing a separate catalyst bed for the reaction. This approach differs from the conventional industry approach because separate catalysts are typically employed and hydrogen is fed to the reactor as a gas.

Another object of the present invention is to provide a preparation method and system using hydrogen and oxygen cycling which decrepitates, exposes, and activates the metal alloy surface.

Still another object of the present invention is to enhance the decrepitation and activation process by milling the metal alloy while in contact with hydrogen or oxygen or compressed air.

The preparation of fine scale powders generally falls within known chemical or mechanical production methods. Chemically formed powders include aerogels, precipitants, chemical reactions, and vapor deposition. Mechanical methods rely on milling, crushing, or exploding. Many of these methods for powder production are utilized in the field of metal parts fabrication or ceramics. Mechanical decrepitation of the metal hydride compounds is known for the preparation of fine powders of the hydride or base metal and makes use of the embrittlement induced by hydride phase formation in metals, such as, for example, hydriding zirconium to promote embrittlement for further machine working. Similarly, titanium hydrides have been hydrided, crushed, molded and sintered to produce metal parts (see, for example, Uenishi Japanese patent document 63089636), and niobium hydrides were thermally cycled to decrepitate metal.

Metal powders which reversibly form metal hydrides can also be decrepitated by hydride-dehydride cycling as described by U.S. Pat. No. 4,893,756. There the apparatus and process for hydride-dehydride metal hydride cycling is provided for the purpose of comminuting an ingot of metal hydride for hydrogen storage applications, specifically for use in electrochemical cells. That document does not demonstrate, however, the advantages of decrepitation and embrittlement resulting from alternating oxygen and hydrogen exposures, i.e. hydrogen/oxygen cycling, nor is the added benefit of performing oxygen/hydrogen cycling in conjunction with mechanical milling recognized.

The method of the present invention utilizes a novel combination of chemical and mechanical particle decrepitation, namely, the reaction of oxygen and hydrogen within the metallic lattice and mechanical disintegration aided by hydrogen embrittlement. That is, the present invention uses hydriding and oxidizing of metals which forms $H_2O$ within the metal lattice thereby causing local distortions and dislocations (defects) of the metal lattice. In cycling or exposing an oxide or hydride to hydrogen or oxygen, respectively, water is formed at grain boundary sites on the metal accompanied by vast increases in volume, and therefore stresses. This stress is typically relieved by generation of cracks and holes in the lattice. In addition to the effect of water formation, the hydride cycling process alone generates lattice expansions because the density of the metal hydride is less than the pure metal. This process also generates internal stress, relieved through the formation of cracks and holes. The use of mechanical milling or agitation has also been found to facilitate stress relief in hydride cycling and hydride and oxide cycling.

Although embrittlement by hydrogen to facilitate mechanical decrepitation and the method of hydride-dehydride cycling to decrepitate metals and metal alloys which form hydrides are known, we were the first to discover the benefit of alternating hydrogen-oxygen (or air) exposures. The use of oxygen exposure as an integral step in powder decrepitation is counter-intuitive because the exposure of the hydriding-dehydriding material to oxygen has generally been avoided given the fact that oxygen is a known poison to reversible metal hydrides in a setting of their intended use.

The present invention teaches for the first time that the use of oxygen cycling in conjunction with hydrogen cycling can in fact be beneficial for powder decrepitation due to the large internal stresses generated by the formation of water molecules within the structure of the metal alloy where previously only an oxide or hydride specie was present.

Furthermore, the present invention departs from the prior art which did not use mechanical agitation of the material during the oxygen/hydrogen cycling to further enhance the decrepitation of the metal alloy resulting from embrittlement and large internal stresses caused by the presence of water molecules within the metal alloy structure.

A presently preferred method for decomposing and/or immobilizing organic wastes which may contain halogens, sulfur, phosphorous, single bonds, double bonds, and triple bonds comprises the step of first preparing complex metal alloys through decrepitation and activation using a cyclic hydrogen, oxygen or air exposure process; and secondly, contacting the activated complex metal alloy with the organic waste compound. The complex metal alloys are comprised of two or more metals comprised of transition metals, alkaline metals (Group IIA) and/or one or more rare earth metals, and prepared using a process which decrepitates and creates active metal, metal oxide and/or metal hydride surface.

The activation process in accordance with the present invention comprises the step of exposing the metal alloy to hydrogen and oxygen or air to activate the surface and decrepitate the powder to a form with a higher surface area and higher lattice defect. The activation process can also be enhanced or accelerated further by milling the metal alloy while exposing it to the hydrogen so the material is in a hydrided state, or by milling the metal alloy while exposing it to oxygen or air after exposure to hydrogen, thereby leaving hydrogen absorbed on the metal alloy thereby producing an alloy comprised of catalyst and hydrogen source.

We have found that milling the materials in the presence of hydrogen or oxygen accelerates the reaction of the metal alloys with the oxygen or hydrogen by exposing fresh surface through which the oxygen or hydrogen can diffuse and react with the underlying metal alloy thereby forming the oxide or hydride materials. The milling process also relieves stresses accumulated within the lattice of the metal alloy due to the presence and volume differential associated with oxides, hydrides, and water.

The mechanical milling process can be carried out with a standard ball mill or milling jar with grinding media such as burundum, zirconia, nylon, or polyurethane grinding stones. Ultrasonic agitation is also another contemplated effective method to mechanically agitate or mill the particulates when oxides, hydrides, or water are present in the metallic lattice. The milling operation takes place according to a prescribed end point particle size established by prior testing using known techniques.

Regardless of the previous number of hydrogen and oxygen exposure cycles, the hydrogen/oxygen exposure process terminates, with an exposure to oxygen or air, to form an active surface oxide. The powdered metal alloy is then placed in contact with the waste organic compound.

The complex metal alloys utilized in the present invention have at least one metal which forms a stable oxide and one component which is generally described as a catalyst. For example, the alloys $CaNi_5$, $Mg_2Ni$, and $LaNi_5$, Ca, Mg, and La form very stable oxides, and the presence of Ni or NiO on the surface of these alloys serves as a catalyst. Rare earth metals other than La are contemplated as equally effective in alloy compositions. For example, a combination of rare earth metals termed "mischmetal" which includes La, Ce, Nd, and Pr is sometimes used in place of La. In the alloys TiFe or $TiFe_{0.9}Mn_{0.1}$, a combination of two or more transition metals, the components may form an oxide. In this case, the iron, titanium and manganese may serve as oxidation agents or catalysts.

We attribute the effectiveness of the complex alloys of our invention to a synergism between the metallic components which has not heretofore been achieved with a metal oxide destructive adsorbent or transition metal catalyst separately. Likewise a physical mixture or coating cannot achieve the same properties as the present invention because we believe that the metal components are not within atomic distances of one another throughout the entire bulk of the compound.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF CURRENTLY PREFERRED EMBODIMENTS

Figure 1:
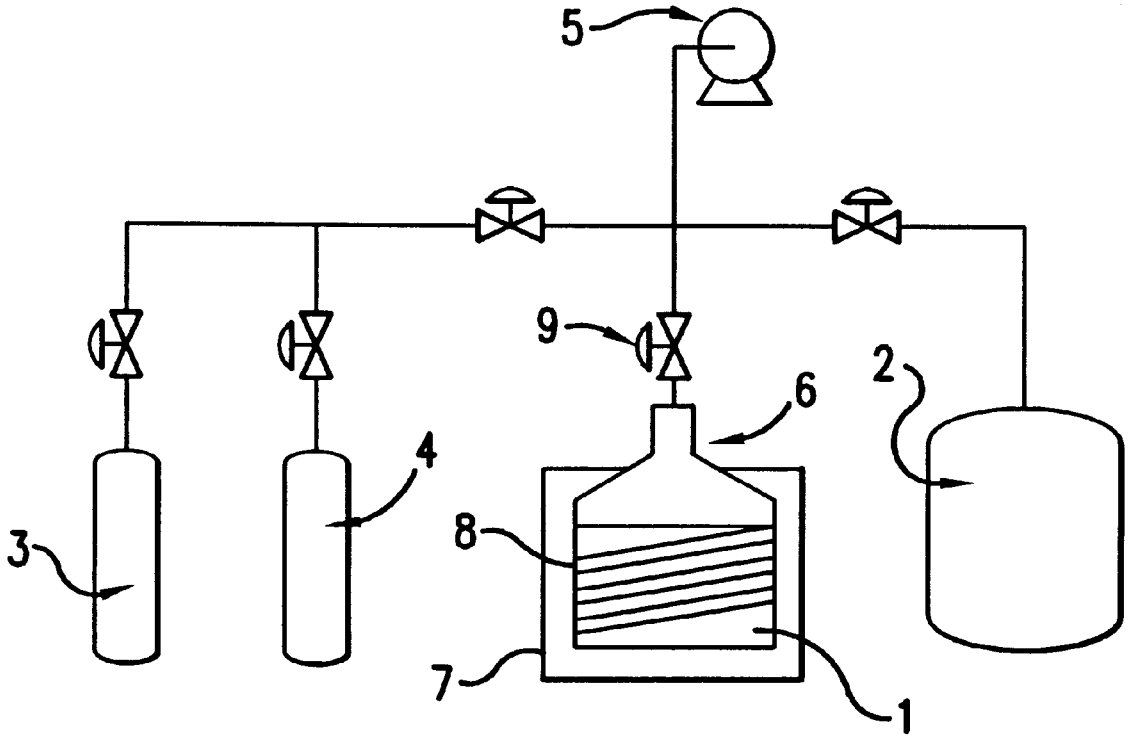
FIG. 1 is a schematic diagram of metal alloy activation station, and an organic waste decomposition vessel.

A schematic of the metal alloy powder preparation components are shown in FIG. 1. The metal alloy activation station consists of a vessel 6 which encloses the metal alloy, and a manifold for connections to vacuum 5, hydrogen 3, and oxygen or air 4. The vessel containing the organic waste compound 2 can also be included in the system to facilitate immediate waste destruction after the metal alloy material has been prepared. Alternatively, the organic waste vessel can be at a separate location. The powder preparation reactor 6 is shown with auxiliary cooling unit 7 for use during the exothermic hydride process. A resistance heater 8 can also be used for initial activation of the powders, and hydrogen desorption steps. Heating the hydride material under vacuum via vacuum pump 5 has been found to increase the kinetics of the absorption process and speed up the initial activation process.

The method consists of first preparing the metal alloy compound by filling vessel 6 with material 1 in an ingot or pulverized form. If milling is to be performed during the hydrogen or oxygen exposures, milling stones will also be placed in the reactor in quantities recommended by the milling stone manufacturer. The vessel 6 must be capable of holding vacuum to approximately 50 millitorr or less, and preferably constructed of stainless steel. The material is then subjected to vacuum, sealed in vacuum, and then exposed to hydrogen from cylinder 3. Heat may also be applied to accelerate the adsorption of hydrogen. This first activation procedure, in which a metal is heated moderately (e.g., <200° C.) in an atmosphere of hydrogen, reduces surface impurities such as S, C, Cl, and O, as will be familiar to those skilled in the art of metal hydride applications. The charging pressure for the initial hydrogen exposure and subsequent absorption reaction with the metal alloy depends on the specific alloy, but generally ranges from 100–500 psia.

Figure 2:
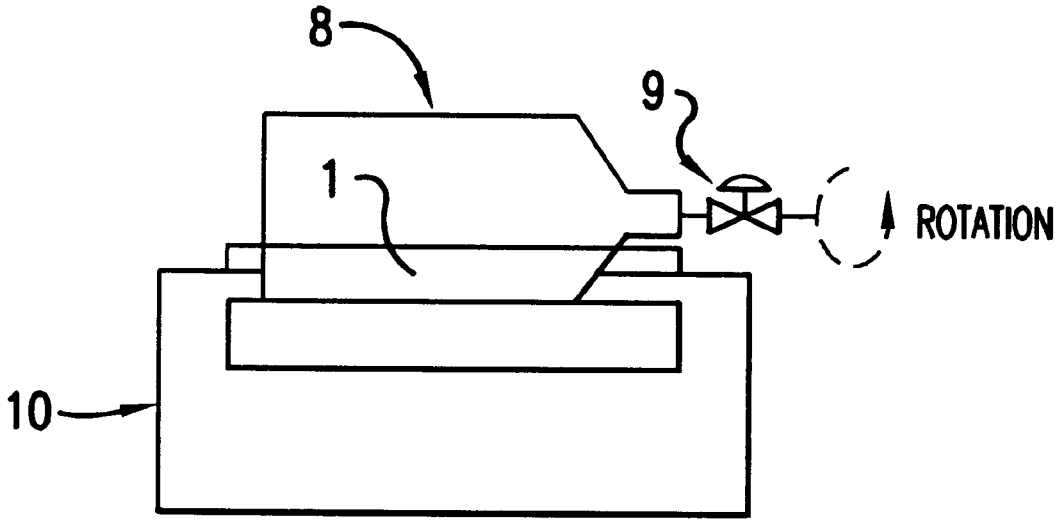
FIG. 2 is a schematic diagram of metal alloy hydride and oxide comminution station with mechanical jar mill.

Vessel 6 can also be heated during this process or disconnected from the system above valve 9 and placed on a mill 10 as seen in FIG. 2. Each of these operations accelerates the initial hydrogen absorption process. After the material has reacted with the hydrogen to form a hydride, the vessel is heated and subjected to vacuum to extract or desorb the absorbed hydrogen on the metal alloy. Depending on the alloy, it may be necessary to apply heat to the vessel and hydrided alloy during this operation.

Upon evacuation of hydrogen, the metal alloy is introduced to oxygen or dry compressed air from cylinder 4. The level of evacuation of hydrogen prior to the introduction of oxygen will generally be 500 millitorr or less, but instances could be identified where it is desired to leave higher pressures in the cylinder. The residual hydrogen on the metal alloy will react with the oxygen to form water, which can cause large internal stresses due to the formation of water molecules within the lattice of the metal where the hydrogen atom once resided. Typically the partial pressure of oxygen introduced to the powder is 15 psia, so that when using compressed air, the cylinder can be charged to approximately 75 psia air. Vessel 6 is then disconnected from the system above valve 9 and placed on a mill 10 in FIG. 2 to enhance the decrepitation process and relieve internal stresses caused by the formation of water within the metal alloy lattice.

The vessel 6 is then evacuated to a vacuum pressure of approximately. 50 millitorr, filled with hydrogen, and evacuated. When hydriding the alloy, heat is generated by the exothermic reaction. To maximize the quantity of hydrogen absorbed and to limit the hazards associated with rapid heat generation, the vessel 6 is generally cooled by a device 7 when the material 1 begins to absorb hydrogen. Cooling will also preclude any undesired light sintering which may otherwise occur within the powder bed.

This process, comprised of combinations of hydrogen and oxygen exposures, optionally mechanical milling, and evacuations, is then carried out until the desired degree of decrepitation is achieved or when the powder has reached an activated level proven effective in prior organic waste destruction tests. The set point evacuation pressure between hydrogen and oxygen/air exposures can be varied to affect the quantity of residual hydrogen and oxygen contained by the metal alloy and to thereby affect the quantity of water which will form within the lattice of the metal during each cycle.

Prior to the completion of the process, the metal can be exposed one final time to hydrogen to form the hydride, or can be evacuated to desorb all of the hydrogen contained in the metal. For the final step of this preparation process, the vessel can either be opened to the atmosphere and the powder removed to be placed in a vessel for reaction with the organic waste, or the vessel could then be directly attached to another vessel 2 containing the organic compounds without exposing the metal alloy to the atmosphere. We have found that certain metal alloys such as $Mg_2Ni$ can be exposed to air and transferred to another vessel for reaction with the organic waste compound.

Figure 3:
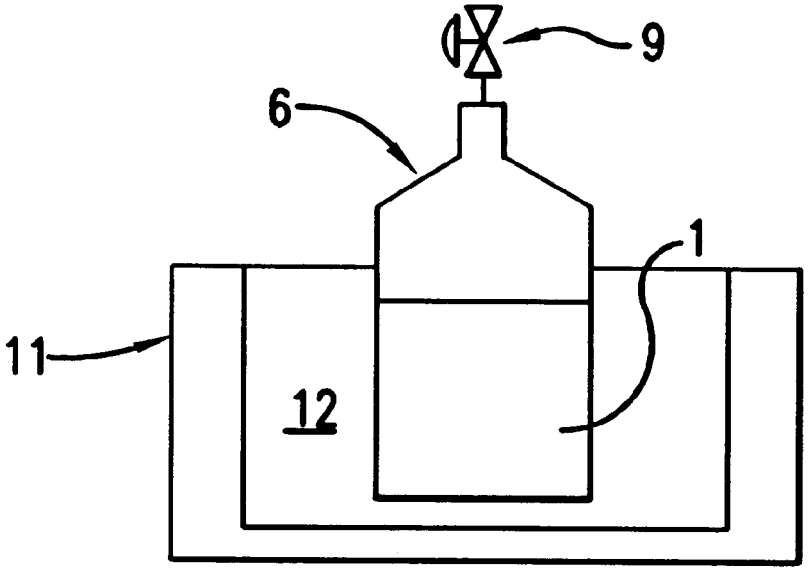
FIG. 3 is a schematic diagram of metal alloy hydride and oxide comminution station using ultrasonic agitation.

The enhancement of the metal alloy decrepitation and activation process can be effected through an ultrasonic mechanical agitation. An ultrasonics transducer and tank 11 can be used as seen in FIG. 3 by submerging the vessel 6 containing the metal alloy hydride or oxide 1 in a liquid bath 12. Ultrasonic transducers could also, however, be directly mounted on the vessel 6.

The following working examples utilize various metal alloys, a halogenated organic compound, i.e. chloroform, a double-bond containing compound, i.e. stearic acid, and chemical warfare agent simulants dimethyl methyl-phosphonate and 2,2'-thiodiethanol, which contains the hetero-atom phosphorous and sulfur, respectively, in accordance with the present invention. These examples are not meant to be all inclusive to the invention, but rather, to be illustrative of the expected conversions and properties of the hetero-atom (e.g., Cl atoms in chloroform) P atom in dimethyl methyl-phosphonate, S atom in 2,2'-thiodiethanol) and higher-order bond (e.g., double bond in stearic acid) organic compound decomposition. Accordingly, the decomposition and/or immobilization ability of the metal alloys toward stearic acid and dimethyl methyl-phosphonate show the utility of other unsaturated compounds such as ethylene's and benzene's, as well as nerve agents such as Sarin. Similarly, the decomposition capability of the metal alloys toward chloroform demonstrate utility for the materials to decompose or immobilize other compounds containing halogens such as F, Cl, I, and Br (e.g., mustard gas, $S(CH_2CH_2Cl)_2$, and other halogenated solvents.

EXAMPLE 1

A 150 g sample of $CaNi_5$ alloy was prepared according to the above described method of the present invention. That is, the initial raw materials, having a mesh size of approximately −10 to −12, were loaded into a 1 liter stainless steel cylinder fitted with Cajon metal gasket connections and a thermal well for placement of a thermocouple. Burundum grinding stones measuring ½" diameter by ½" long were also placed in the cylinder at 8.5 pounds per gallon of void volume. The alloy powder was prepared using alternating 500 psia hydrogen/75 psia air exposure cycles repeated four times and separated by vacuum purge to 50 millitorr or less, with mechanical milling during each exposure cycle. The final powder had a specific surface of 0.71 $m^2/g$, and a basicity as measured by the pH of a 0.05 molar solution equal to 11.8.

The material was removed from the production reactor after a final exposure to room air, and then introduced to chloroform at 300° C. for tests ranging from 1 to 3 hours in duration. The presumed form of this alloy after exposure to air is $CaNi_5O_x$, where x is the net stoichiometry of metal alloy oxide at completion of the preparation process. The quantities of materials used were 5 mmoles of $CaNi_5$ and 1.25 mmoles $CHCl_3$ (or 0.75 moles Cl per mole of metal) for an excess of metal alloy agent by a proportion of 4:1.

We also investigated the effect of additional $CHCl_3$ (2.5 and 5 mmoles) in some experiments to determine any cut-off's in capacity for the $CaNi_5$ material. The percent destruction of $CHCl_3$ decreased only slightly when decreasing the ratio of metal to $CHCl_3$ from 4:1 to 1:1. The conversion of chloroform after 1 hour was measured to be 95% by dissolving the final powder in water and testing for chloride. The overgas produced by the reaction was not found to be acidic, but rather, neutral. Based on the measured Cl produced from dissolution of the metal alloy salt in DI water, the approximate stoichiometry of the final metal alloy substrate was about $Ca(Cl_{0.7})Ni_5$. The endpoint stoichiometry when the metal alloy:chloroform ratio was 1:1 was measured to be 2.6, indicating the structure $Ca(Cl_{2.6})Ni_5$.

EXAMPLE 2

A $Mg_2Ni$ alloy was prepared according to the method of the present invention. That is, approximately 150 g of initial raw materials having a mesh size of approximately −10 to −12 was loaded into a 1 liter stainless steel cylinder, sealed and evacuated by vacuum pump. The alloy powder was prepared using 2 hydrogen/air exposure cycles, producing a final specific surface of 1.5 $m^2/g$, and a basicity as measured by the pH of a 0.05 molar solution equal to 11.1. The material was removed from the production reactor and introduced to chloroform at 300° C. for 4 hours. The conversion of chloroform after 4 hours was measured to be 70% by dissolving the final powder in water and testing for chloride. The decomposition of stearic acid was measured to be 100%. The overgas produced by the reaction was not found to be acidic, but rather, neutral.

EXAMPLE 3

Approximately 150 g of $LaNi_5$ having a mesh size of −10 to −12 was loaded into a 1 liter stainless steel cylinder. The alloy powder was prepared using 1 hydrogen and 1 air exposure cycle, producing a final specific surface greater than 0.02 $m^2/g$, and a basicity as measured by the pH of a 0.05 molar solution greater than 6.9. The material was removed from the production reactor by exposure to room air, and then introduced to chloroform at 300° C. for 4 hours in duration. The quantities of materials used were 5 mmoles of $LaNi_5$ and 1.25 mmoles $CHCl_3$ (or 0.75 moles Cl per mole of metal) for an excess of metal alloy agent by a proportion of 4:1. The conversion of chloroform after 4 hours was measured to be 79% by dissolving the final powder in water and testing for chloride. The overgas produced by the reaction was neutral by litmus paper. Based on the measured Cl produced from dissolution of the metal alloy salt in DI water, the approximate stoichiometry of the final metal alloy substrate was about $La(Cl_{0.59})Ni_5$.

EXAMPLE 4

A similar reaction to EXAMPLES 1, 2, and 3 was carried out using CaO powder having a surface area of 2.5 $m^2/g$. The basicity of a 0.05 molar solution of this powder was pH=12.66. Using 5 mmoles CaO per 1.25 mmole $CHCl_3$, the conversion of chloroform was 36%, which translates to a final stoichiometry of the CaO substrate equal to 0.27 (0.27 moles Cl per mole Ca). The equivalent reaction using $CaNi_5$ resulted in a stoichiometry of 0.7 and chloroform conversions of greater than 90% which illustrates the enhanced activity of the $CaNi_5$ alloy containing Ni.

EXAMPLE 5

An activated 50 g sample of $CaNi_5$ powder of initial mesh size −10 to −12 was prepared with 5 oxygen/hydrogen cycles. During the process of exposing the sample to hydrogen or oxygen, the vessel containing the alloy was placed in an ultrasonics bath filled with water. The basicity as measured by the pH of a 0.05 molar solution equal to 11.63. The material was removed from the production reactor and introduced to chloroform at 300° C. for 4 hours. The conversion of chloroform after 4 hours was measured to be greater than 99% by dissolving the final powder in water and testing for chloride. Over a temperature range of room temperature up to about 70° C., and a ratio of 0.10 moles stearic acid to mole of metal, greater than 99% of the stearic acid was neutralized when contacted with the metal alloy powder.

EXAMPLE 6

Twenty-five grams of a $CaNi_5$ alloy powder was prepared using two hydride/dehydride cycles, a final hydriding step to form the partially-hydrided metal hydride of approximate composition $CaNi_5H_3$, followed by slow exposure to air. Approximately 2–2.5 grams of this sample was then placed in a 10 mL volumetric cleaned dry flask, and two to three drops of DMMP (a mass of 0.02 to 0.06 grams) was added to produce a mixture of approximately 1–5 percent DMMP by weight. This powder/DMMP mixture is then completely mixed and left to react for 15 minutes at room temperature, after which acetonitrile was used to extract any remaining DMMP. The acetonitrile and metal powder slurry is then filtered with a 0.45 micrometer filter and the liquid is injected into a high performance liquid chromatograph (HPLC) and analyzed for concentration of DMMP using a 200 nm UV/VIS detector. Comparing the results to a powder which had not been activated and prepared by this technique, we found that 71% of the DMMP had been neutralized.

EXAMPLE 7

Twenty-five grams of a $Mg_2Ni$ alloy powder was prepared using two hydride/dehydride cycles, a final hydriding step to form the partially-hydrided metal hydride of approximate composition $Mg_2NiH_2$, followed by slow exposure to air. Approximately 2–2.5 grams of this sample was then placed in a 10 mL volumetric cleaned dry flask, and two to three drops of DMMP (a mass of 0.02 to 0.06 grams) was added to produce a mixture of approximately 1–5 percent DMMP by weight. This powder/DMMP mixture is then completely mixed and left to react for 15 minutes at room temperature, after which acetonitrile was used to extract any remaining DMMP. The acetonitrile and metal powder slurry is then filtered with a 0.45 micrometer filter and the liquid is injected into a high performance liquid chromatograph (HPLC) and analyzed for concentration of DMMP using a 200 nm UV/VIS detector. Comparing the results to a powder which had not been activated and prepared by this technique, we found that more than 90% of the DMMP had been neutralized.

EXAMPLE 8

A activated powder alloy of $TiFe_{0.9}Mn_{0.1}$ was prepared from a −10 to −12 mesh raw material having a surface area of about 0.071 $m^2/g$. Four cycles of (1) hydriding, (2) evacuating, (3) air exposure, (4) milling, and (5) evacuating were performed followed by a final exposure to air. The final powder had a surface area of 0.67 $m^2/g$. This powder was then exposed to $CHCl_3$ at 300° C. for 1 hour. By mass balance, it was determined that 94% of the chloroform had been destroyed.

EXAMPLE 9

A activated powder alloy of $TiFe_{0.9}Mn_{0.1}$ was prepared using 3 hydriding/dehydriding cycles , followed by a final hydride cycle leaving the alloy in the state approximated by the formula $TiFe_{0.9}Mn_{0.1}H_2$, then followed by a final exposure to air. The resulting powder was then exposed to $CHCl_3$ at 300° C. for 4 hours. By mass balance, it was determined that 91% of the chloroform had been destroyed. Over a temperature range of room temperature up to about 70° C., and a ratio of 0.10 moles stearic acid to mole of metal, 91% of the stearic acid was neutralized when contacted with the metal powder.

EXAMPLE 10

Twenty-five grams of a $TiFe_{0.9}Mn_{0.1}$ alloy powder was prepared using two hydride/dehydride cycles, a final hydriding step to form the partially-hydrided metal hydride of approximate composition $TiFe_{0.9}Mn_{0.1}H$, followed by a slow exposure to air. Approximately 2–2.5 grams of this sample was then placed in a 10 mL volumetric cleaned dry flask, and two to three drops of DMMP (a mass of 0.02 to 0.06 grams) was added to produce a mixture of approximately 1–5 percent DMMP by weight. This powder/DMMP mixture was then completely mixed and left to react for 15 minutes at room temperature, after which water was used to extract any remaining DMMP. The water and metal powder slurry was then filtered with a 0.45 micrometer filter and the liquid injected into a high performance liquid chromatograph (HPLC) and analyzed for concentration of DMMP using a 200 nm UV/VIS detector. Comparing the results to a powder which had not been activated and prepared by this technique, we found that 97% of the DMMP had been neutralized.

The same material was also exposed to 2,2'-thiodiethanol, $S(CH_2CH_2Cl)_2$. Approximately the same proportion and weights were used as with the DMMP test, and HPLC analysis was performed at a pre-determined optimal wavelength of 225 nm. The measured reduction of 2,2'-thiodiethanol was 22% for the 15 minute exposure and an approximate 33:1 ratio of metal alloy hydride to 2,2'-thiodiethanol.

While the invention has been described in connection with currently preferred embodiments, procedures, and examples, it is to be understood that such detailed description was not intended to limit the invention on the described embodiments, procedures, or examples. Instead, it is the intent of the present invention to cover all alternatives, modifications, and equivalent which may be included within the spirit and scope of the invention as defined by the claims appended hereto.

What is claimed is:

1. A method of decomposing or immobilizing an organic compound containing at least one hetero-atom, comprising the steps of preparing a powdered compound comprised of at least two alloyed metals selected from the group consisting of transition metals, alkaline metals and rare earth metals, and contacting the organic compound with the powdered compound.

2. The method of claim 1, wherein the at least one hetero-atom is a halogen.

3. The method of claim 1, wherein the at least one hetero-atom is phosphorous.

4. The method of claim 1, wherein the at least one hetero-atom is sulfur.

5. The method of claim 1, wherein the organic compound contains at least one double bond.

6. The method of claim 1, wherein the transition metals are selected from the group of consisting of Cu, Ni, V, Cr, Mn, Fe, Ti, and Zr.

7. The method of claim 1, wherein the alkaline metals are selected from the group consisting of Mg and Ca.

8. The method of claim 1, wherein the rare earth metals are selected from the group consisting of Ce, La, Nd, or Pr.

9. A method of preparing a powdered compound comprised of at least two alloyed metals selected from the group consisting of transition metals, alkaline metals and rare earth metals, comprising the steps of alternately exposing the alloyed metal to hydrogen and then to oxygen or air, subjecting the exposed alloyed metal to vacuum evacuation between the exposures, and repeating the alternate exposure steps as necessary with the vacuum evacuation subjecting step therebetween.

10. The method of claim 9, further comprising the step of mechanical milling the alloyed metal during at least one of the alternate exposure steps.

11. The method of claim 9, further comprising the step of ultrasonic agitation of the alloyed metal during at least one of the alternate exposure steps.

12. A method for activating metal alloy compounds, comprised of at least two alloyed metals selected from the group consisting of transition metals, alkaline metals and rare earth metals, comprising the steps of preparing a powdered metal alloy, one of hydriding and dehydriding the powdered metal alloy and selectively further decrepitating the powdered metal alloy during hydriding or dehydriding so as to accelerate activation.

13. A method as claimed in claim 12, wherein the decreptitation step is performed by one of mechanical milling and ultrasonic agitation.

14. A method for decrepitating metal alloy compounds, comprised of at least two alloyed metals selected from the group consisting of transition metals, alkaline metals and rare earth metals, comprising the steps of alternately exposing the metal compounds to hydrogen and to oxygen or air; and selectively further decrepitating the metal alloy compounds by one of mechanical milling and ultrasonic agitation.

15. A system for decomposing or immobilizing an organic compound comprised of at least one hetero-atom, comprising means for providing an activated metal alloy powder comprised of at least two metals selected from the group consisting of transition metals, alkaline metals and rare earth metals, and means for contacting the organic compound with the activated metal alloy powder.

16. The system according to claim 15, wherein the providing means comprises apparatus for exposing the metal alloy powder to alternate exposures of hydrogen and one of oxygen or air, with vacuum evacuation between the alternate exposures.

17. The system according to claim 16, wherein mechanical milling of the metal alloy powder occurs during at least one of the alternate exposures.

18. The system according to claim 16, wherein ultrasonic agitation of the metal alloy powder occurs during at least one of the alternate exposures.

19. A metal alloy powder consisting essentially of at least two alloyed metals selected from the group consisting of transition metals and alkaline metals and prepared by the process of subjecting the metal alloy to alternating hydriding and dehydriding cycles.

20. The metal alloy compound according to claim 19, wherein the process includes the step of selectively further decrepitating via one of mechanical milling and ultrasonic agitation.

21. A method of using a metal alloy compound produced by the process of claim 9, comprising the step of contacting the metal alloy compound with an organic compound containing at least one hetero-atom.

22. A method of preparing a powdered compound comprised of at least two alloyed metals selected from the group consisting of transition metals, alkaline metals and rare earth metals, comprising the steps of exposing the alloyed metal to hydrogen and to oxygen in a predetermined order and in a predetermined number of exposures, subjecting the exposed alloyed metal to vacuum evacuation between the exposures, and repeating the exposure steps as necessary with the vacuum evacuation step therebetween.

23. The method of claim 22, further comprising the step of mechanical milling the alloyed metal during at least one of the alternate exposure steps.

24. The method of claim 22, further comprising the step of ultrasonic agitation of the alloyed metal during at least one of the alternate exposure steps.

25. A method of using a powdered compound produced by the process of claim 9, comprising the step of contacting the powdered compound with an organic compound containing at least one hetero-atom.

26. A method of using an activated metal alloy compound produced by the process of claim 12, comprising the step of contacting the metal alloy compound with an organic compound containing at least one hetero-atom.

27. A method of using a decrepitated metal alloy powder produced by the process of claim 14, comprising the step of contacting the metal alloy powder with an organic compound containing at least one hetero-atom.

28. A method of using a metal alloy compound produced by the process of claim 22, comprising the step of contacting the metal alloy compound with an organic compound containing at least one hetero-atom.

29. A metal alloy powder comprising Mg and at least two alloyed metals selected from the group consisting of transition metals and rare earth metals, and prepared by the process of subjecting the metal alloy to alternating hydriding and dehydriding cycles.

30. The metal alloy powder according to claim 29, where the process includes the step of selectively further decrepitating via one of mechanical milling and ultrasonic agitation.

31. A metal alloy powder comprising Mn and at least two alloyed metals selected from the group consisting of alkaline metal and rare earth metals, and prepared by the process of subjecting the metal alloy to alternating hydriding and dehydriding cycles.

32. The metal alloy powder according to claim 31, where the process includes the step of selectively further decrepitating via one of mechanical milling and ultrasonic agitation.

* * * * *